US007118666B2

(12) United States Patent
LaCamera et al.

(10) Patent No.: US 7,118,666 B2
(45) **Date of Patent: *Oct. 10, 2006**

(54) PROTECTING AN INERT ANODE FROM THERMAL SHOCK

(75) Inventors: Alfred F. LaCamera, Trafford, PA (US); Leroy E. D'Astolfo, Lower Burrell, PA (US); James T. Burg, Verona, PA (US)

(73) Assignee: Alcoa Inc., Pittsburgh, PA (US)

( * ) Notice: Subject to any disclaimer, the term of this patent is extended or adjusted under 35 U.S.C. 154(b) by 443 days.

This patent is subject to a terminal disclaimer.

(21) Appl. No.: 10/374,002

(22) Filed: Feb. 25, 2003

(65) Prior Publication Data

US 2003/0127339 A1 Jul. 10, 2003

Related U.S. Application Data

(63) Continuation-in-part of application No. 09/940,248, filed on Aug. 27, 2001, now abandoned.

(51) Int. Cl.
*C25C 3/06* (2006.01)
*C25C 3/12* (2006.01)

(52) U.S. Cl. ..... 205/390; 205/372; 205/384; 205/386

(58) Field of Classification Search ..... 205/372, 205/380, 384–388, 390, 396
See application file for complete search history.

(56) References Cited

U.S. PATENT DOCUMENTS 3,236,753 A 2/1966 Skantze et al. ..... 205/386
3,238,052 A * 3/1966 Burak et al. ..... 106/798
3,852,107 A * 12/1974 Lorkin et al. ..... 428/367
3,960,678 A * 6/1976 Alder ..... 205/384
4,490,233 A 12/1984 Casdas ..... 156/62.2
4,612,105 A * 9/1986 Langon ..... 204/288.2
6,447,667 B1 * 9/2002 Bates et al. ..... 205/384
6,558,526 B1 * 5/2003 D'Astolfo et al. ..... 205/389
2002/0074235 A1 6/2002 D'Astolfo et al. ..... 205/354

FOREIGN PATENT DOCUMENTS

WO 98/53120 A1 11/1998
WO WO 9853120 A1 * 11/1998
WO 99/36591 A1 7/1999
WO WO 9936591 A1 * 7/1999

* cited by examiner

*Primary Examiner*—Nam Nguyen
*Assistant Examiner*—Luan V. Van
(74) *Attorney, Agent, or Firm*—Greenberg Traurig, LLP

(57) ABSTRACT

A method for protecting anode assemblies in an electrolytic cell from thermal shock is disclosed. The method generally involves applying a thermal insulating layer (8, 16) to the anode (2) prior to preheating the anode assembly in a furnace, where the layer (8, 16) protects the anode (2) from thermal shock during transfer from the preheat furnace to the electrolytic cell. In a preferred embodiment the anode (2) is attached to a castable plate (4) that is also protected from thermal shock by an insulating layer.

17 Claims, 1 Drawing Sheet

PROTECTING AN INERT ANODE FROM THERMAL SHOCK

PENDING RELATED APPLICATION

This application is a continuation-in-part of U.S. Ser. No. 09/940,248 filed Aug. 27, 2001 now abandoned for "Cermet Inert Anode Assembly Thermal Insulating Layer".

FIELD OF THE INVENTION

The present invention relates to methods for protecting electrodes from thermal shock. More specifically, the present invention relates to protection of inert anodes and their support structure from thermal shock during electrolytic cell start-up operations.

BACKGROUND INFORMATION

Aluminum is produced conventionally by the electrolysis of alumina dissolved in cryolite-based molten electrolytes at temperatures between about 900 and 1000° C.; the process is known as the Hall-Heroult process. A Hall-Heroult reduction cell typically comprises a steel shell having an insulating lining of refractory material, which in turn has a lining of carbon that contacts the molten constituents. Conductor bars connected to the negative pole of a direct current source are embedded in the carbon cathode substrate that forms the cell bottom floor. The carbon lining and cathode substrate have a useful life of three to eight years, or even less under adverse conditions. The deterioration of the cathode bottom is due to erosion and penetration of electrolyte and liquid aluminum as well as intercalation of sodium, which causes swelling and deformation of the cathode carbon blocks and ramming mix. In addition, the penetration of sodium species and other ingredients of cryolite or air leads to the formation of toxic compounds including cyanides. Anodes are at least partially submerged in the bath.

In operation, the conventional cell contains an electrolytic, molten cryolite-based bath in which alumina is dissolved. A molten aluminum pool acts as the cathode. A crust of frozen electrolyte and alumina forms on top of the bath and around the anode blocks. As electric current passes through the bath between the anode and cathode surfaces, alumina is reduced to aluminum, which is deposited in the pad of molten metal.

Electrolytic reduction cells must be heated from room temperature to approximately the desired operating temperature before the production of metal can be initiated. Heating should be done gradually and evenly to avoid thermal shock, which can in turn cause breakage or spalling. The heating operation minimizes thermal shock to the lining, the electrodes and the support structure assemblies upon introduction of the electrolyte and molten metal to the cell. Once at operating temperatures carbon anodes wear out and are replaced. Carbon anodes can be placed in to the electrolyte cold and heated by the energy of the cell to operating temperatures, at which time the nominal current of the anode will be attained. Ceramic anodes that have much longer lives are prone to thermal shock and therefore need to be preheated in a furnace outside of the electrolytic cell prior to insertion into the hot electrolyte. During transfer, the cooling or heating of the anodes must also be minimized to avoid thermal shock. The thermal shock/cracking can occur both during movement of the anodes into position and during their placement into the molten salt. Thermal shock relates to the thermal gradient (positive or negative) through the anode that occurs during the movement from the preheat furnace to the cell, and also upon insertion of the anodes into the molten salt. A thermal gradient as low as 50° C. can cause cracking. An attempt to protect electrodes in an electrolysis cell from thermal shock during start-up, U.S. Pat. No. 4,265,717, taught protection of hollow cylindrical $TiB_2$ cathodes by inserting aluminum alloy plugs into the cathode cavity and further protecting the cathode with a heat dispersing metal jacket having an inside heat insulating layer contacting the $TiB_2$, made of expanded, fibrous kaolin-china clay ($Al_2O_3 \cdot 2SiO_2 \cdot 2H_2O$), which would subsequently dissolve in the molten electrolyte.

Aluminum electrolysis cells have historically employed carbon anodes on a commercial scale. The energy and cost efficiency of aluminum smelting can be significantly reduced with the use of inert, non-consumable, and dimensionally stable anodes. Use of inert anodes rather than traditional carbon anodes allows a highly productive cell design to be utilized, thereby reducing capital costs. Significant environmental benefits are also realized because inert anodes produce essentially no $CO_2$ or $CF_4$ emissions. Some examples of inert anode compositions are provided in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799 assigned to Alcoa Inc. These patents are incorporated herein by reference. Ceramic anodes, unlike their carbon predecessors, can undergo thermal shock and cracking if heated or cooled too quickly. Methods of protecting inert anodes from thermal shock are therefore desired.

SUMMARY OF THE INVENTION

The present invention is directed to methods for protecting ceramic or cermet inert anodes from thermal shock. The methods generally comprise applying a thermal insulating layer, or "boot" around the inert anode. The insulating layer or boot is applied to the anode before preheating begins, and remains on the anode during positioning of the anode into the cell and submersion of the anode into the molten bath. Inert anodes, which are often made of a cermet or ceramic material, are prone to thermal shock that can cause cracking of the anode material. Preheating of the anodes to the approximate operating temperature of the Hall cell before placing them into the cell is therefore desired to minimize the thermal shock experienced when the anodes are placed in the molten salt. Because the anodes can be rapidly cooled or heated, heat transfer during movement of the anodes from the preheat furnace to the cell must also be minimized.

Similarly, the castable box or plate to which the anodes are attached are subject to thermal shock. The plates, typically made of a refractory material such as a silica or alumina ceramic, can also crack as a result of thermal gradients experienced during transfer from the pre-heat furnace to the cell. Accordingly, the present invention is further directed to methods for protecting castable plates from thermal shock by applying a thermal insulating drape, or "sweater" around the plates.

The present invention minimizes the thermal gradient to which inert anodes and castable plates are exposed while being transferred from a preheat furnace to an electrolytic cell. A significant advantage of the present invention is that the insulating boots and sweaters do not have to be removed prior to inserting the anodes into the cell. In past systems it was necessary to remove the boots before placing the anodes in the Hall cells; this exposed personnel to high temperatures and potential burns. These previous methods also delay anode transfer, and still result in exposure of the anode to cooling that can cause thermal gradients in excess of 50° C. In addition, since the boots remain on the anodes during submersion into the molten bath, they also protect the anodes from a sudden increase in heat from the hot bath that can also cause cracking.

DETAILED DESCRIPTION OF THE INVENTION

Figure 1:
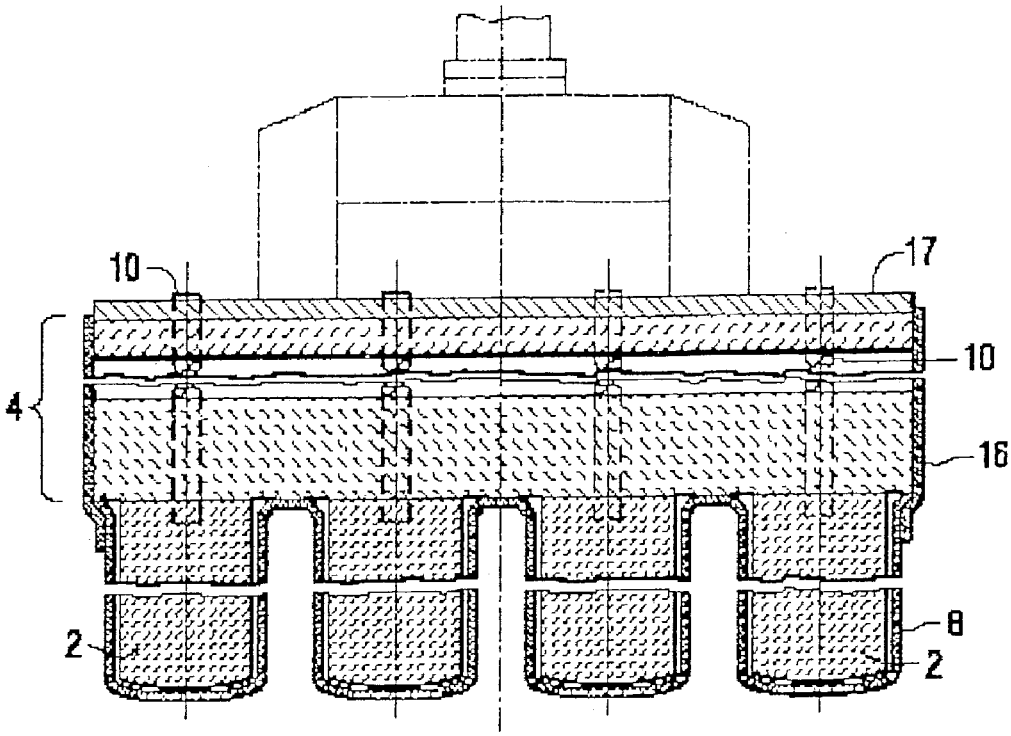
FIG. 1 shows an anode assembly of the present invention in which an insulating layer is applied to the anodes and castable plate such that the layer is in direct contact with the anode.

The present invention is directed to a method for protecting an inert anode from thermal shock comprising applying a thermal insulating layer to the anode; preheating the anode, preferably in an external furnace; and transferring the heated anode to an electrolytic cell. Preferably, the inert anode is made of a ceramic or cermet material. The present invention is further directed to a method for protecting a castable box or plate from thermal shock comprising applying a thermal insulating layer to the plate prior to pre-heating. The plate is preferably made from a silica or alumina ceramic material.

"Insulating layer" is used herein to refer collectively to thermal insulation materials including insulating "boots", used for anode protection, and insulating drapes or "sweaters", used for castable plate protection. The anodes and castable plate are sometimes referred to collectively herein as the anode assembly. It will be appreciated that inert anodes and their support structure assemblies typically comprise additional components, such as a lid fastened over the castable box or plate and a support beam that supports the lid. These additional components may also be protected with an insulating layer according to the present invention, although their risk of thermal shock is significantly less.

The insulating boots of the present invention are made of materials that can be placed into the molten salt, and thus the anodes can go from the preheat furnace to the cell without requiring the additional step of boot removal. The molten salt will penetrate and dissolve the boots, thereby permitting the inert anode to begin carrying current almost immediately upon immersion into the cell. Thus, according to the present invention the cermet inert anodes are protected from the cooling environment of the air during transfer, and are also protected from the potentially higher temperatures of the molten salt. Both positive and negative thermal gradients, which are potential causes of thermal shock and cracking, are therefore minimized, if not eliminated, according to the present methods. Similarly, the insulating drapes used in the present methods can go from the preheat furnace to the cell without being removed from the castable plate. While the castable plate is not itself immersed into the cell, fumes emanating from the molten salt will eventually dissolve the drape or sweater used to protect the plate. As with the anode, the plate is protected from cooling when being transported from the preheat furnace to the cell according to the present methods.

The thermal insulating layers of the present invention can be made from any material having a thermal conductivity at 900° C. to 1000° C. sufficient to prevent the anode assembly from experiencing a thermal gradient of greater than 50° C. Typically, the thermal conductivity between 900° C. and 1000° C. will be between about 0.2 and 1 watt/meter ° K (w/m ° K). It will be appreciated that the lower the thermal conductivity the better the insulation ability of the material. In addition, the material is preferably in the form of cloth, fiber, felt and the like. Such a material provides ease of handling due to its flexibility, and can be more readily applied to the anode assembly. Following submersion of the anodes into the molten bath, a boot having a cloth, fiber or felt consistency will absorb the molten bath and dissolve relatively quickly. It is preferred that the insulating boot dissolve in one minute or less following submersion in the bath. Thus, while materials such as wood, dense ceramics, or glass can be used for the insulating layer, they are not preferred.

Preferred materials for use in the thermal insulating layers of the present invention are "silica materials", which term refers collectively to materials comprised of silica in any chemical form, alone or in conjunction with other elements; examples include aluminum silicate ($Al_2O_3 \cdot 3SiO_2$ or $3Al_2O_3 \cdot 2SiO_2$) and silica dioxide ($SiO_2$).

The aluminosilicate material is preferably in the form of a fibrous blanket that is made of fine fibers. The fine fibers usually go into solution easily, and thus the boot is readily dissolved in the molten salt bath. The boot provides a minor source of alumina available for reduction to aluminum during the electrolytic process. The amount of silica introduced to the cell from the boot is a minimal amount, such that no appreciable contamination or adverse effect is caused by its introduction. A preferred aluminosilicate material is commercially available from 3M™ Ceramic Textiles & Composites under the tradename Nextel. It is very strong fabric that can be used to support other insulating materials.

Other preferred materials are comprised of $SiO_2$. An $SiO_2$ fiber material approximately half an inch thick is commercially available from Cooperknit, Piscataway, N.J., under the trademark "Cooperknit" This material has a thermal conductivity at 900° C. of about 0.338 w/m ° K, and thus is ideally suited for the present invention. Again, the amount of silica introduced to the electrolytic cell from the boots is insignificant, and will be removed from the bath by the aluminum metal pad and diluted by metal production within a matter of days. A silica needled mat can also be used according to the present invention. One such material is sold under the trademark "PyroSil SNM" and is commercially available from PyroShield Inc., Crown Point, Ind. in various thicknesses; the product has a thermal conductivity at 1000° C. of about 0.268 w/m ° K.

In one embodiment of the present invention the boots and/or drapes are comprised of two or more different materials. The materials used in the multilayer embodiment are as described above. It will be appreciated that some of these materials will have a higher risk than others of being ripped, flaked off, brushed off or otherwise damaged during the handling of the preheat steps. Other materials offer greater durability. A tear in the boots and/or drape can result in localized cooling that could lead to cracking of the anode assembly. Preferably, the outermost portion of the insulating layer is of a more durable material that can withstand the handling to which the anode assembly is subjected during preheat and placement into the cell. A preferred combination is a CooperKnit™ layer adjacent the anode assembly covered by a Nextel layer. "Insulating layer", as used herein, encompasses such multi-layer embodiments. Also, when using an insulating layer on the anodes and the plate, the layers used for each can be made of different materials.

The insulating layer should be physically attached to the anode and lid, such as during assembly of the anode assembly. For example, the boot can be slipped over the anode and attached with wire, ceramic string or cloth. When the anode is submerged the attachment means will melt or dissolve in the bath. Again, any contamination resulting from the attachment means is insignificant. Alternatively, the boots/drapes can be adhered to the anode assembly. If an adhering compound is used in the present methods it is preferably a non-organic cement or alumina or silica material, as the introduction of organic adhesives to the system could result in undesirable by-products.

Figure 2:
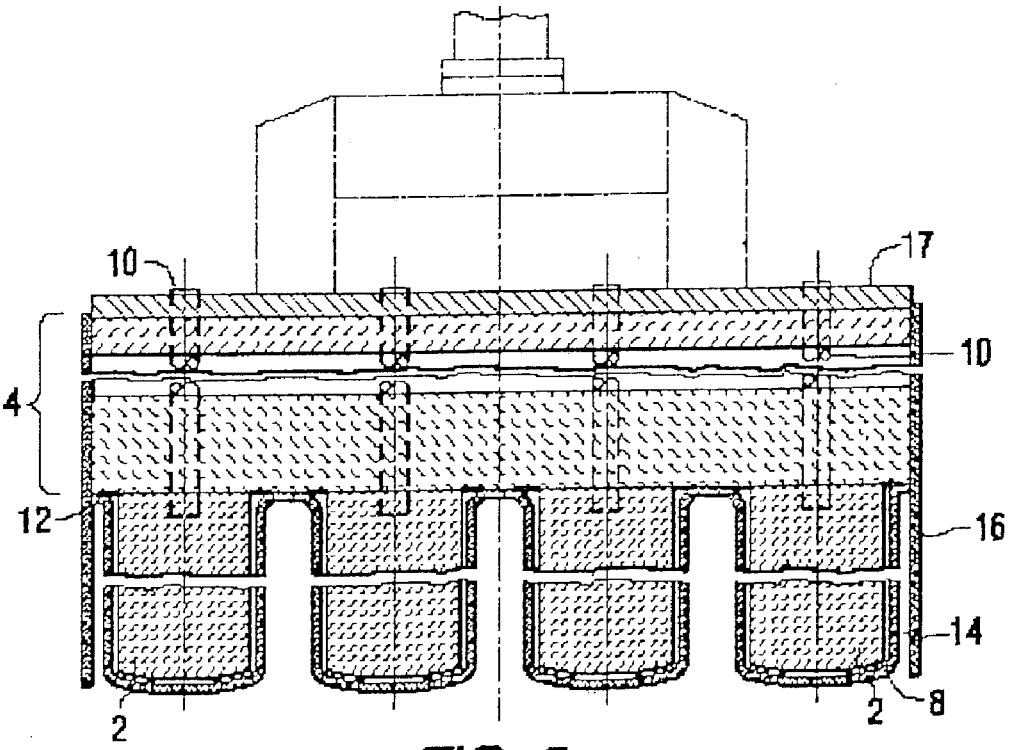
FIG. 2 shows an anode assembly of the present invention in which the insulating layer is hung from the anode so as to create an air gap between the layer and the anode.

The insulating boot 8 can be applied so that it is directly attached to the anode 2, as shown in FIG. 1, or so that it creates an air gap 14 along with drape 16 around the anode, as shown in FIG. 2. With further reference to FIG. 1, anode 2 is attached to steel plate 17 by means of pins 10 and supports the castable plate 4 and insulation around the castable plate 4. Drape 16 is attached to plate 4 by means of wire, ceramic string or cloth (not shown). Insulating boot 8 is in direct contact with the majority of the anode 2. In FIG. 2, insulating boot 8 is attached to anode 2 near the point 12 at which the anode 2 meets the castable plate 4. Here, drape section 16 hangs down around anode 2, creating air gap 14. The drape 16 in FIG. 1 is a short drape while the drape 16 in FIG. 2 is a long drape.

The thickness of the boot and drape will vary depending on the insulation qualities of the particular material used. For example, if the thermal conductivity of the material is high, a thicker boot or drape will be required. The closer the thermal conductivity is to 0.2 w/m ° K the thinner the boot/drape may be while still providing the desired level of insulation. If a multilayer boot/drape is used, the thickness of the outer most layer will typically be less than any other layers. Typically, the thickness of insulating layers of the present invention is about 5 cm. (2 inches) or less. The thermal insulating layer or layers must have a total thickness of at least about 1 mm., preferably at least about 5 mm. A thickness in a range of about 5–50 mm. is preferred. Optimally, the insulating layer has a thickness of about 10–30 mm. The insulating layer has a density of less than 1 g/cm$^3$, preferably less than about 0.5 g/cm$^3$, and more preferably less than about 0.2 g/cm$^3$. The most suitable insulating materials have a density of about 0.1–0.2 g/cm$^3$.

Following application of the insulating boot to the anode, and optionally the application of the drapes to the lid, the anode assembly can then be heated in a furnace external to the electrolytic cell. Heating is typically effected at a rate of between about 15° C. and 45° C. per hour; preferably, the rate is between about 25° C. and 30° C. per hour. Thus, heating of the anode assembly from room temperature to approximately 1000° C. can take several days.

Following the heating step, the anode assembly is transferred to the electrolytic cell. Typically, the external furnace is 22.9–27.5 meters (25–30 yards) away from the cell. In open air, the temperature of the anode will drop quickly absent the presence of the insulating boot. Thus, the boot maintains the temperature of the anodes and avoids a thermal gradient sufficient to cause cracking. The drape similarly maintains the temperature of the plate. Transport can be effected by any means known in the art, such as by use of a crane.

It is a significant advantage of the present invention that the insulating layers do not need to be removed from the anode assembly prior to positioning of the anode assembly in the cell and submersion of the anodes into the molten salt bath. Following submersion of the anodes into the bath, the insulating boots of the present invention will preferably dissolve in approximately a minute or less and the drape at a slower rate. Because the plate need not conduct current like the anodes, the rate at which the drape dissolves is not thought to be important.

The present invention is also directed to an inert anode covered at least in part with a thermal insulating boot. The boot is as described above. The present invention is further directed to an anode assembly comprising a plurality of inert anodes attached to a castable plate; the inert anodes are covered at least in part with thermal insulating boots as described above and the castable lid is covered at least in part with a thermal insulating drape or sweater.

Any inert anode can be used in the present invention, for example, those described in U.S. Pat. Nos. 4,374,050; 4,374,761; 4,399,088; 4,455,211; 4,582,585; 4,584,172; 4,620,905; 5,279,715; 5,794,112; 5,865,980; and 6,126,799. "Inert anode" as used herein refers to a substantially nonconsumable anode that possesses satisfactory corrosion resistance and stability during the aluminum production process. Preferably, the inert anode is a ceramic inert anode or a cermet inert anode. "Cermet" refers to an inert anode comprising a ceramic phase and a metal phase. For example, the ceramic phase can contain oxides of iron, nickel and/or other metals; the metal phase can contain one or more metals such as Cu, Ag, Pd, Pt, Au, Ph, Pu, Ir or Os. The cermet inert anodes used in the present invention can be made entirely of cermet material, or can comprise an outer coating or layer of cermet material over a central core.

EXAMPLES

The following examples are intended to illustrate the invention, and should not be construed as limiting the invention in any way.

The methods of the present invention were successfully tested using the anode assemblies depicted in FIGS. 1 and 2. Anodes and lids were covered with a two-layer thermal insulating layer, comprised of Cooperknit™ insulation and preheated in a furnace to a temperature of between about 900° C. and 1000° C. The anode assemblies were transferred to an electrolytic cell with a crane, positioned into the cell, and submerged in molten cryolite. The temperature gradient experienced by the anode assembly between the furnace and the cell was between 30° C. and 100° C. depending on the insulating layers and time of the transfer. Another insulating layer test used PyroSil covered with Cooperknit™. In all cases the anode was successfully protected.

Whereas particular embodiments of this invention have been described above for purposes of illustration, it will be evident to those skilled in the art that numerous variations of the details of the present invention may be made without departing from the invention as defined in the appended claims.

What is claimed is:

1. A method for protecting from thermal shock, a ceramic inert anode used in electrolytic production of aluminum, comprising:

(a) applying to a ceramic inert anode a thermal insulating layer having a thickness of at least about 1 mm;

(b) heating said ceramic inert anode at a rate of between about 15° C. and 45° per hour;

(c) transferring said heated anode to an electrolytic cell, wherein the insulating ceramic inert layer maintains the temperature of the ceramic inert anode during transfer to avoid a thermal gradient sufficient to crack the ceramic inert anode.

2. The method of claim 1, wherein said inert anode is a cermet inert anode.

3. The method of claim 1, wherein said thermal insulating layer comprises a silica material disposed around the ceramic inert anode.

4. The method of claim 1 wherein said thermal insulating layer is comprised of more than one material, with an outermost portion of said layer comprising a material more durable than any other material.

5. The method of claim 1, wherein said heating step is effected at a rate of between about 20° C. and 30° C. per hour, up to a temperature of between about 900° C. and 1000° C.

6. The method of claim 1, wherein after step (c) the anode and insulating layer are inserted into an electrolyte after which the insulating layer is dissolved, and where the temperature gradient between steps(b) and (c) is between 30° C. and 100° C.

7. The method of claim 1, further comprising protecting a castable plate to which the anode is attached by applying a thermal insulating layer to said plate, wherein the thermal insulating layer attached to the plate is the same or different than the thermal insulating layer aft ached to the anode.

8. The method of claim 7, wherein said thermal insulating layer applied to said plate comprises a silica material.

9. The method of claim 7, wherein said thermal insulating layer applied to said plate is comprised of more than one material, with an outermost portion of said layer comprising a material more durable than any other material.

10. The method of claim 7, wherein said castable plate is comprised of a silica ceramic material, an alumina ceramic material or mixtures thereof.

11. The method of claim 1, wherein said insulating layer has a thickness of at least about 5 mm.

12. The method of claim 1, wherein said insulating layer has a thickness of about 5–50 mm.

13. The method of claim 1, wherein said insulating layer has a thickness of about 10–30 mm.

14. The method of claim 1, wherein said insulating layer has a density of less than about 1.0 $g/cm^3$.

15. The method of claim 1, wherein said insulating layer has a density of less than about 0.5 $g/cm^2$.

16. The method of claim 15, wherein said insulating layer has a thickness of about 10–30 mm.

17. The method of claim 1, wherein said insulating layer has a density of about 0.1–0.2 $g/cm^3$.

* * * * *